US006305981B1

(12) United States Patent
Jetter et al.

(10) Patent No.: US 6,305,981 B1
(45) Date of Patent: Oct. 23, 2001

(54) ELECTRICAL CONNECTOR WITH A CONTACT SECURING FLAP

(75) Inventors: Rolf Jetter, Darmstadt; Antonio Lehner, Wiesbaden, both of (DE)

(73) Assignee: The Whitaker Corporation, Wilmington, DE (US)

( * ) Notice: Subject to any disclaimer, the term of this patent is extended or adjusted under 35 U.S.C. 154(b) by 0 days.

(21) Appl. No.: 09/520,621

(22) Filed: Mar. 7, 2000

(30) Foreign Application Priority Data

Mar. 9, 1999 (EP) ..... 99104677

(51) Int. Cl.[7] ..... H01R 13/40
(52) U.S. Cl. ..... 439/595; 439/596; 439/460
(58) Field of Search ..... 439/271, 353, 439/352, 752, 595, 596, 598, 597, 460, 461, 462, 463

(56) References Cited

U.S. PATENT DOCUMENTS 3,423,721 1/1969 Rushton .
4,082,402 4/1978 Kinkaid et al. .
4,618,202 * 10/1986 Libregts et al. ..... 439/499
5,893,775 * 4/1999 Annokkee et al. ..... 439/492
5,980,319 * 11/1999 Yildiz et al. ..... 439/595
6,116,954 * 9/2000 Ries ..... 439/596

* cited by examiner

*Primary Examiner*—Paula Bradley
*Assistant Examiner*—Ann McCamey

(57) ABSTRACT

The invention relates to an electrical connector with a housing with a plurality of contact chambers arranged in at least one row, with contacts arranged in the contact chambers for making contact with a mating contact and with a hinged flap comprising projections which engage in the contact chambers in an end locking position of the flap and secure the contacts therein, wherein the flap can be introduced into an shaft bearing with a shaft perpendicular to the plug-in direction and is rotatably mounted there.

16 Claims, 9 Drawing Sheets

ELECTRICAL CONNECTOR WITH A CONTACT SECURING FLAP

BACKGROUND OF THE INVENTION

1. Field of the Invention

The invention relates to an electrical connector with a housing having a plurality of contact chambers arranged in at least one row with contacts in the contact chambers and with a hinged flap having projections which extend into the contact chambers in a locking position of the flap to secure the contacts therein which is also suited for flat foil conductors.

2. Description of the Prior Art

GB 1525046 discloses an electrical connector with three contact chambers arranged in a row in a housing with contacts therein and a hinged flap with projections. The projections extend into the contact chambers in a locking position of the flap to secure the contacts therein where the hinged flap is connected to the housing via a film hinge.

U.S. Pat. No. 4,082,402 discloses a contact and an electrical connector for flat foil conductors. The electrical connector includes a housing with nine electric contacts arranged in a row, the contacts being suitable for connection to the conductors of a foil and for engaging a mating contact. The housing includes a flap which is hinged to the housing via a film hinge and which can be connected in a locked manner to the housing in a locking position. The flap serves to protect the connections between the contacts and the flat foil conductors. Additional securing of the contacts in the contact chambers is not effected by the hinged flap. Further strain relief on the connector is also not provided.

It is known from EP 866 520 to position flat foil conductors by pins on the housing and corresponding openings in the flat foil conductors and thus also to provide strain relief.

SUMMARY OF THE INVENTION

It is an object of the invention to provide an electrical connector, in particular for a flat foil conductor, that includes an additional securing feature for the contacts that can be produced particularly easily. A further object of the invention is to provide a connector for flat foil conductors that includes additional strain relief for the flat foil. The object is achieved by a connector having the features of the claims.

A particular advantage is that a connector according to the invention includes a strain relief for the flat cable. A further particular advantage is that this strain relief is formed integrally with the housing. This prevents loss of the small pins typically used to provide strain relief.

A further particular advantage is that, when producing the housing for the connector, the flap and the housing can be produced as two separate parts using very simple tools, these two parts being adapted for assembly upon opening of the tools and then being connected to one another by a hinge.

A further particular advantage is that the flap on the housing locks in a pre-locking position and therefore prevents unintentional removal of the flap from the housing.

A further particular advantage is that, with the connector according to the invention, the foil is initially terminated at the contacts and the contacts then introduced into the housing with the foil. The strain relief of the foil is initially effected by the corresponding arrangements and the flap can then be brought into its end position to check whether the contacts are located in the correct position. To prevent removal of the contact before the flap is brought into the locking position, the contacts also have a so-called first contact securing means, for example, the contacts have a spring tongue which locks behind a corresponding housing shoulder when the contacts are introduced fully into the housing chambers.

DETAILED DESCRIPTION OF THE PREFERRED EMBODIMENT

Figure 1:
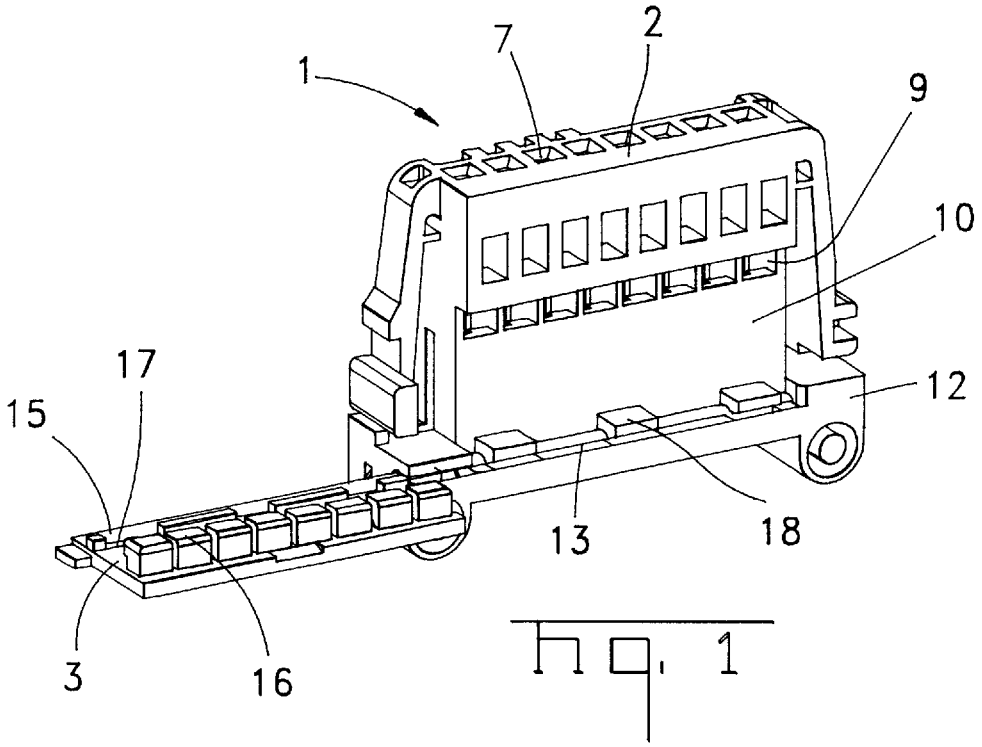
FIG. 1 is a perspective view of a housing with a flap, the flap not yet having been inserted.

A secondary contact securing means of a connector according to the invention will initially be described with reference to FIGS. 1 to 7. Various strain relief arrangements will then be described with reference to FIGS. 8 to 12.

FIGS. 1 to 7 show various perspective views and a cross-section of a connector 1 according to the invention. Only a housing 2 and a flap 3 is shown in some figures (FIGS. 1 to 3 and 7), whereas FIGS. 4, 5 and 6 also show a foil 4 introduced therein.

The housing 2 includes a face 5 and a cable end 6. The housing 2 includes eight contact chambers 7 arranged in a row. The contact chambers 7 extend from the face 5 to the cable end 6 of the housing 2. Each contact chamber 7 serves to receive an electric contact. The electric contact is so designed that it can be assembled with a mating contact and includes a region for engaging a flat foil conductor of the foil 4. Each contact also includes, for example, a catch spring tongue with which it locks behind a shoulder 8 of the contact chamber 7 when the contact is inserted into the contact chamber 7. Each contact chamber 7 also includes an opening 9 through a lateral wall 10 of the housing 2.

The housing 2 includes, on opposing sides, a catch arm 11 for interlocking with a mating connector. The housing 2 also includes a strain relief 12 on each side at the cable end 6.

In addition, the housing 2 includes a bearing track 13 along the lateral wall 10. This is bounded by one of the strain relief arrangements 12 on one side and includes an opening 14 on the other side.

A flap 3 is provided next to the housing 2. The flap 3 consists of a plate, a shaft 15 being provided at one end of the plate and a row of projections 16 at the other end of the plate. The number of projections 16 corresponds to the number of chambers 7.

Figure 2:
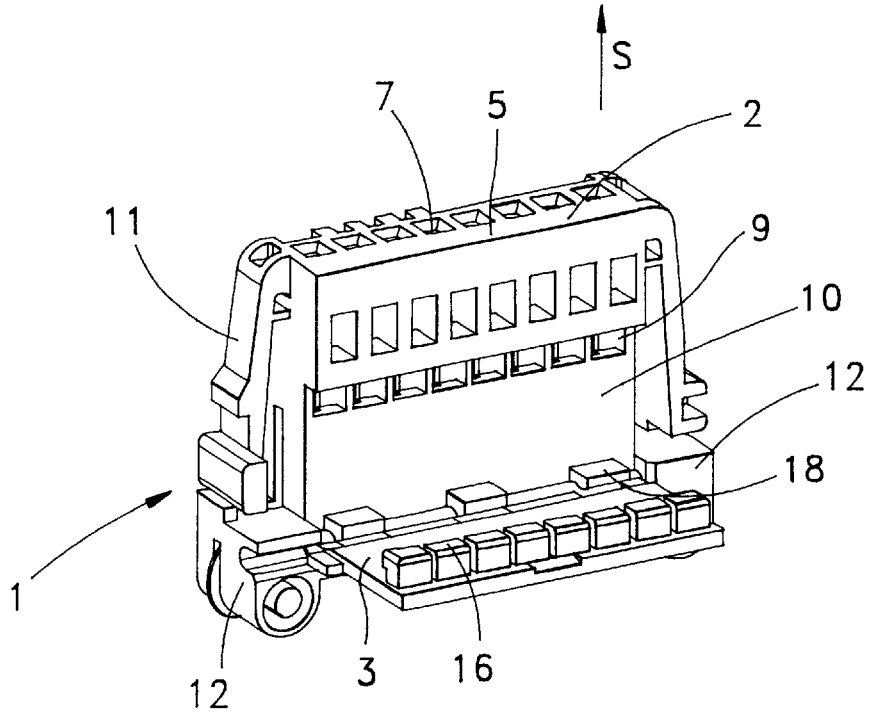
FIG. 2 is a perspective view of a housing with a flap, the flap having been inserted.
Figure 3:
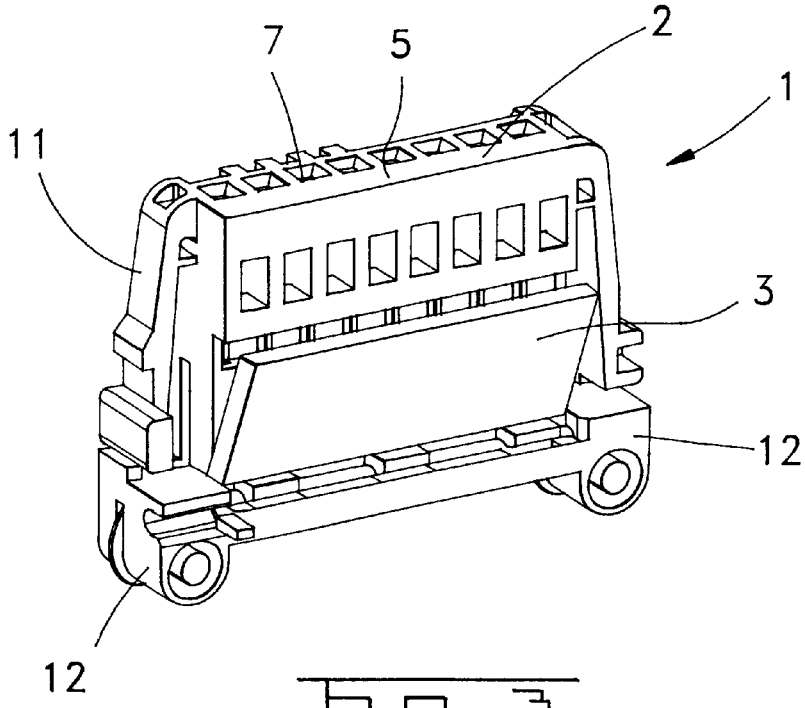
FIG. 3 is a perspective view of a housing with a flap, the flap being in the pre-locking position.
Figure 4:
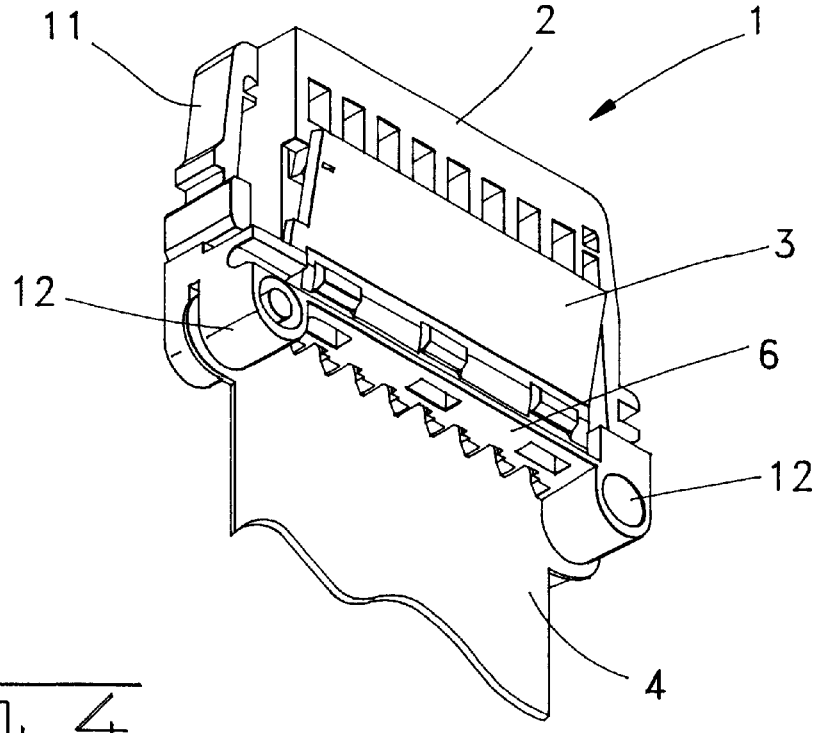
FIG. 4 is a perspective view of a housing with a flap, the flap being in a pre-locking position and contacts being introduced with a flat foil.
Figure 5:
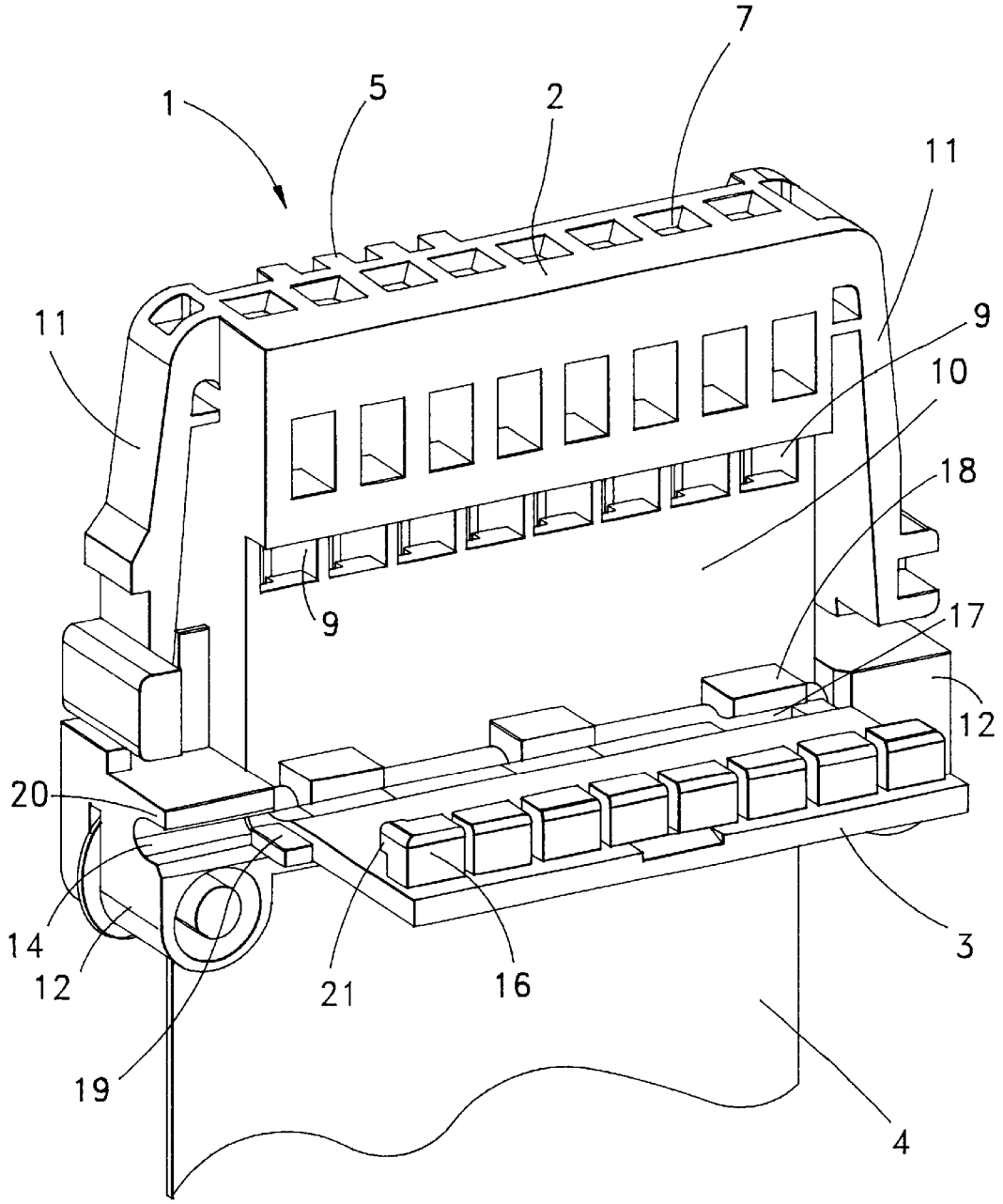
FIG. 5 is a perspective view corresponding to FIG. 2 but with the flat foil and contacts introduced.
Figure 6:
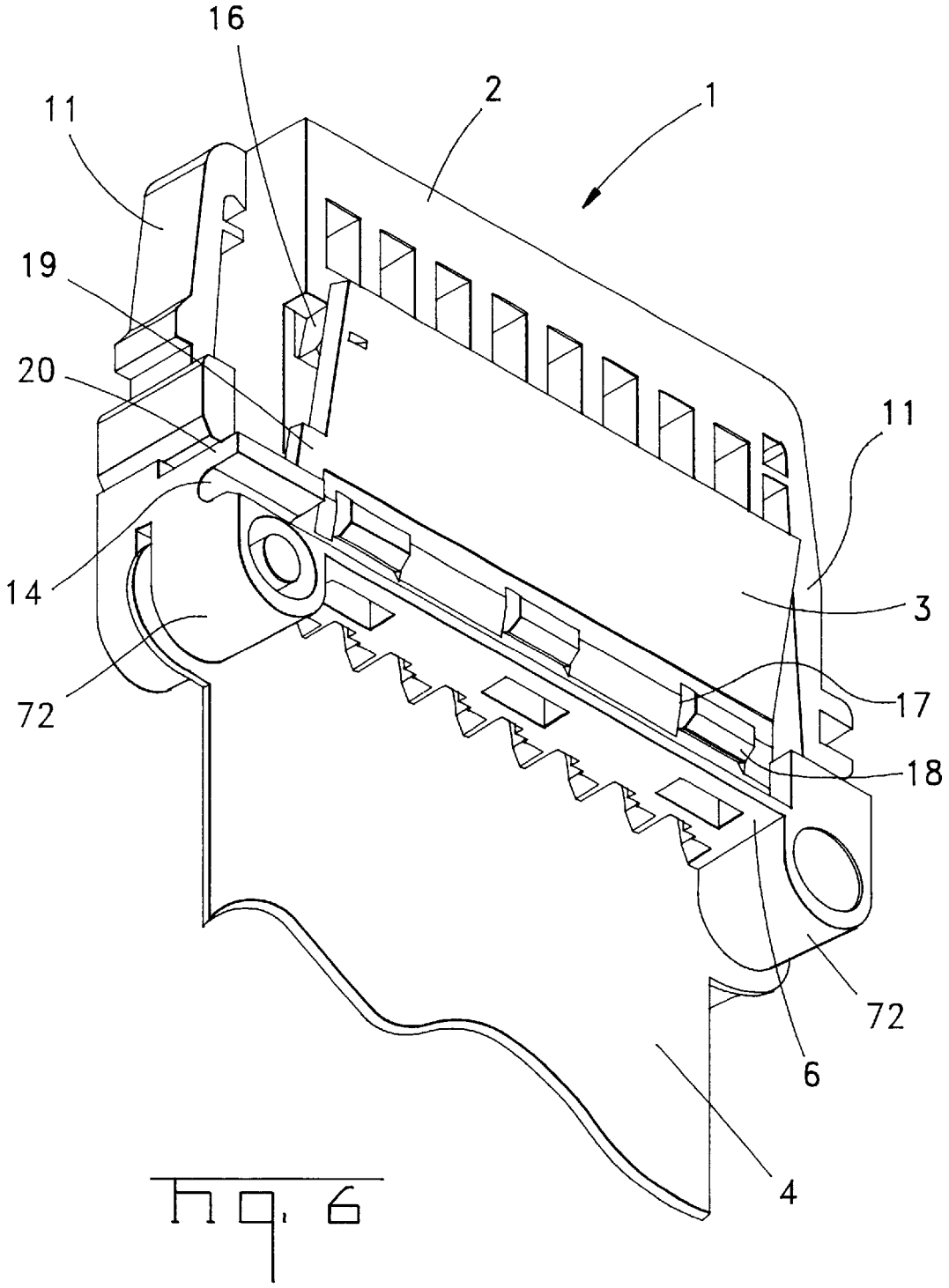
FIG. 6 is a perspective view corresponding to FIG. 5 but with the flap in the pre-locking position.
Figure 7:
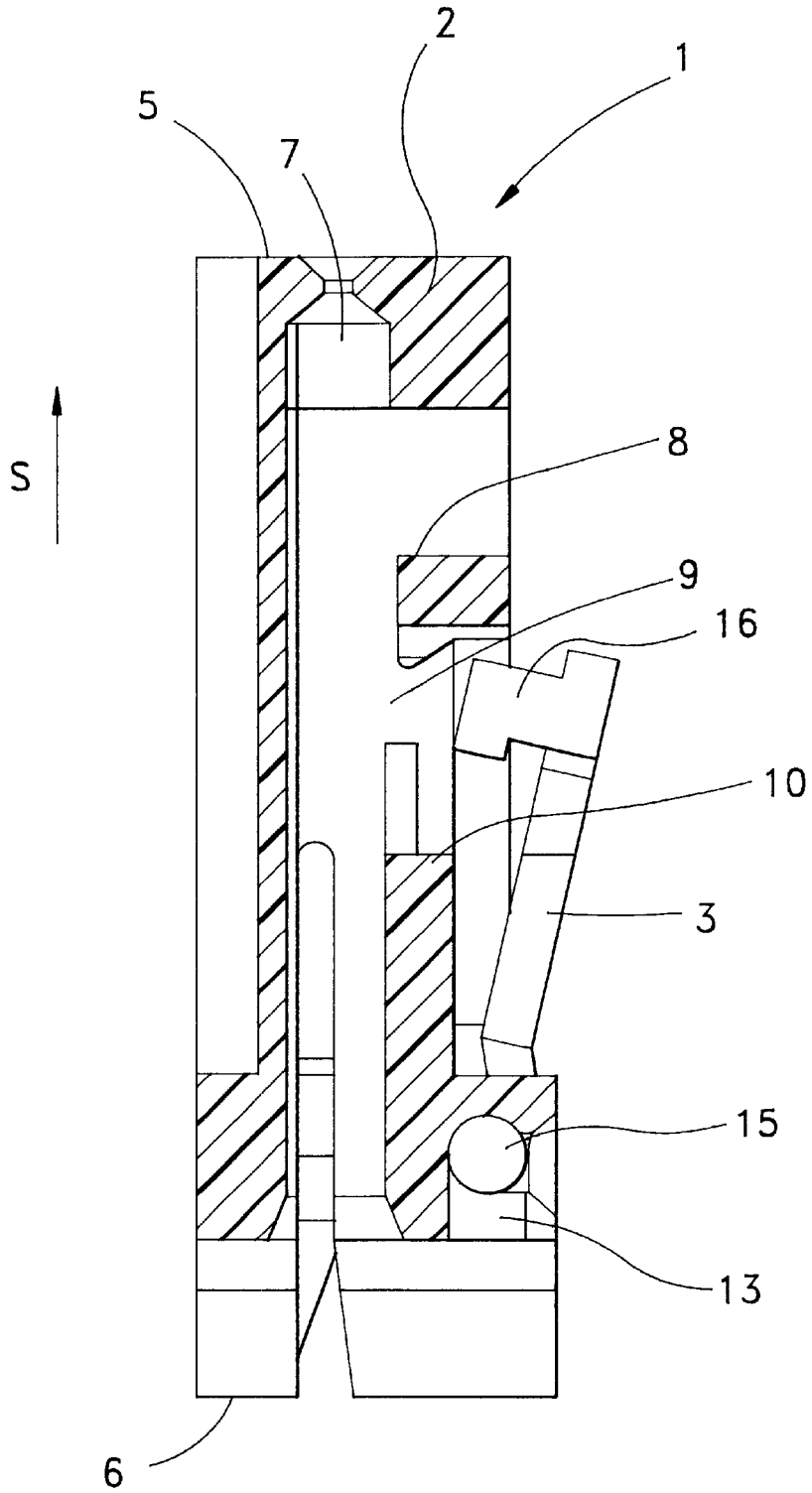
FIG. 7 is a cross-section through a contact chamber corresponding to FIG. 3.

The flap 3 and the housing 2 are produced independently of one another from a thermoplastic material. During the opening of the tools for the injection moulding of the two parts, it is proposed that the flap 3, with shaft 15, be inserted automatically into the bearing track 13 through opening 14. FIG. 1 shows the state of flap 3 and housing 2 prior to insertion. FIGS. 2 and 5 show the flap 3 inserted into the housing. Three longitudinal recesses 17 extend parallel to the shaft 15 are arranged in the flap 3 close to the shaft 15. Three projections 18 are accordingly located on the lateral wall 10 above the shaft bearing 13. When the flap 3 is located in its end position on the housing 2, the projections 18 are arranged above the openings 17. If the flap 3 is accordingly rotated round the shaft 15, the projections 18 engage in the openings 17 and ensure guidance of the flap 3 in the direction perpendicular to the plug-in direction S.

A lug 19 is provided on one side of the flap 3. The lug 19 interacts with the wall 20 and therefore the opening 14. As the flap 3 rotates round the shaft 15, the lug 19 is guided past the wall 20 in an interlocking manner. This ensures that the flap 3 is located in a pre-locking position from which it cannot be removed accidentally. Accidental removal of the flap 3 from the housing 2 is thus prevented.

In the pre-locking position, the projections 16 of the flap 3 run against the openings 9 in the lateral wall 10. Owing to further pressure on the flap 3 in the direction of the housing 2, the projections 16 penetrate into the recesses 9 in the individual chambers 7 and therefore into the chambers 7. The contacts are therefore secured in the chambers 7.

On at least one of the projections 16 there is a catch nose 21 which interacts with the walls of the corresponding recess 9 for interlocking the flap in the locking position.

Figure 8:
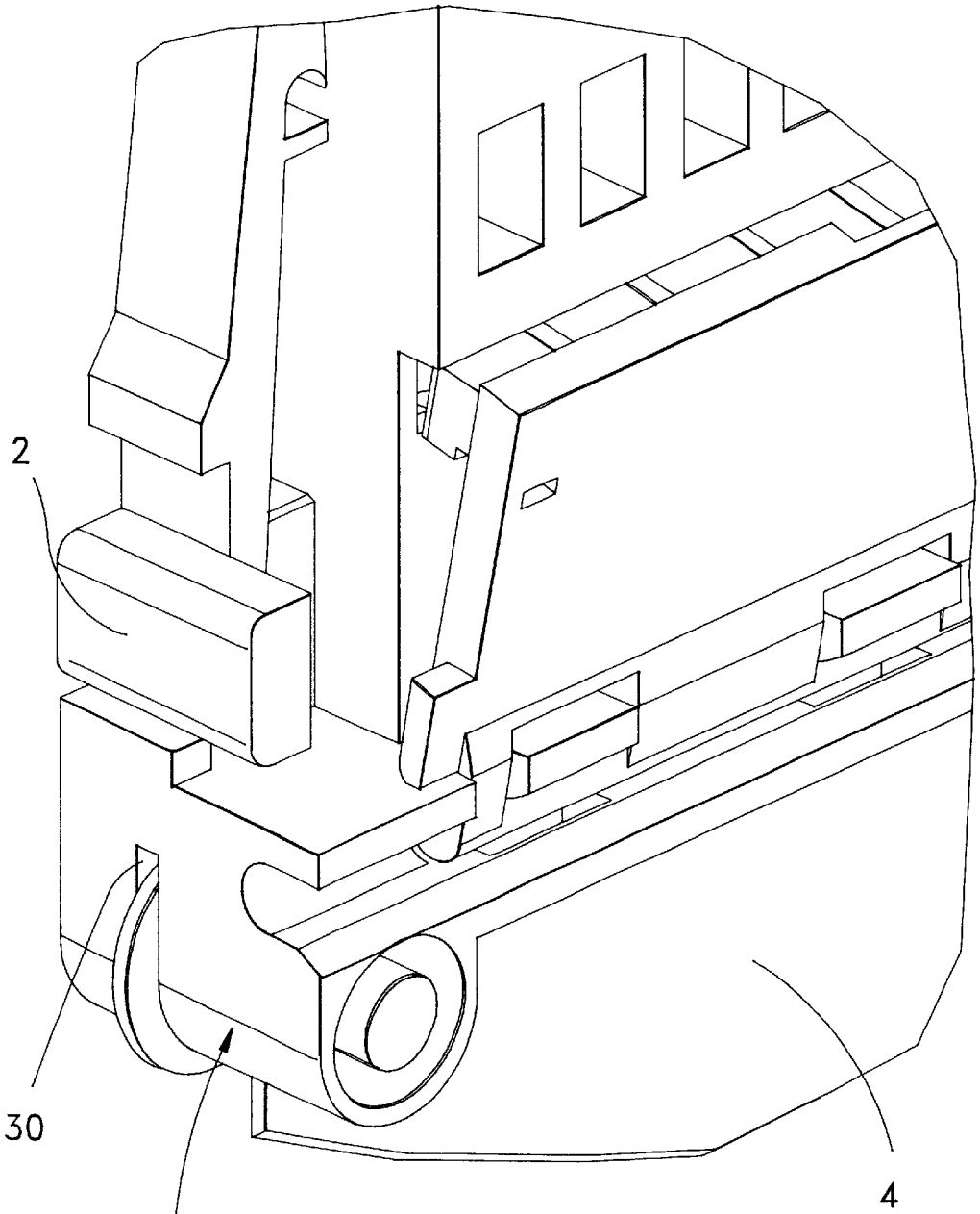
FIG. 8 shows an enlarged detail of the view in FIG. 6.
Figure 9:
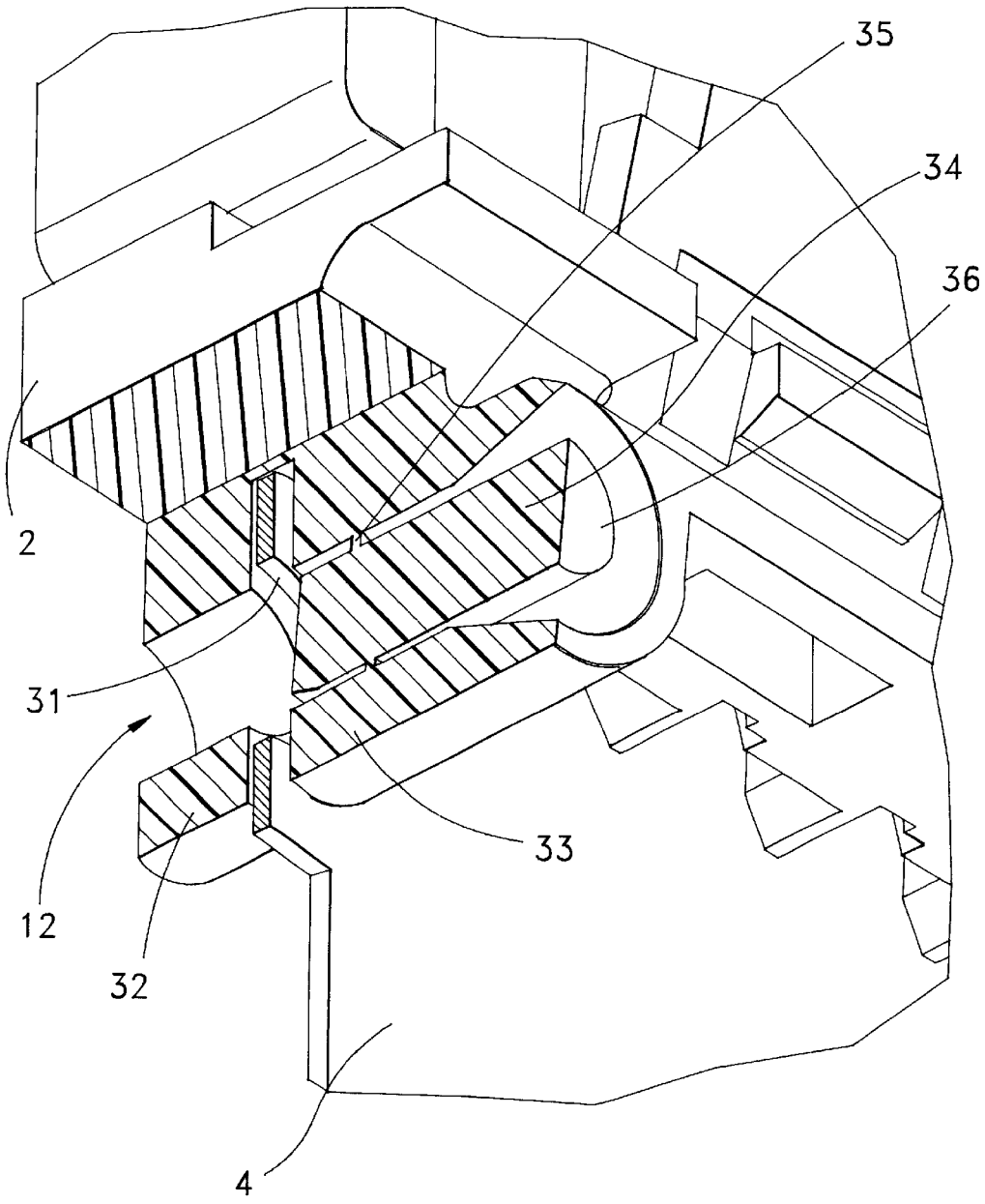
FIG. 9 shows a partial cross-section through a strain relief arrangement with integrally moulded pin.

A first embodiment of the strain relief arrangement 12 will now be described with reference to FIGS. 8 and 9. In this embodiment of the strain relief arrangement 12 located on the housing 2, the strain relief arrangement 12 includes a slot 30 into which a section of the foil 4 can be inserted. The section of the foil 4 includes an opening 31. There is a hollow cylinder 32, on either side of the slot 30. A pin 34 is arranged in one of the two hollow cylinders 33. The pin 34 is connected to the internal wall of the hollow cylinder 33 via a set breaking point 35. Once the foil 4 has been inserted into the slot 30 and is arranged with the opening 31 below the pin 34, the pin 34 is pressed into the opening 31 and through to the second hollow cylinder 32 by pressure on the end face 36 of the pin 34. This forms an interlocking connection so that the foil 4 is secured and a tensile strain of the foil 4 is absorbed by the pin 34 and not transmitted to the connection between the contacts and the foil 4.

Figure 10:
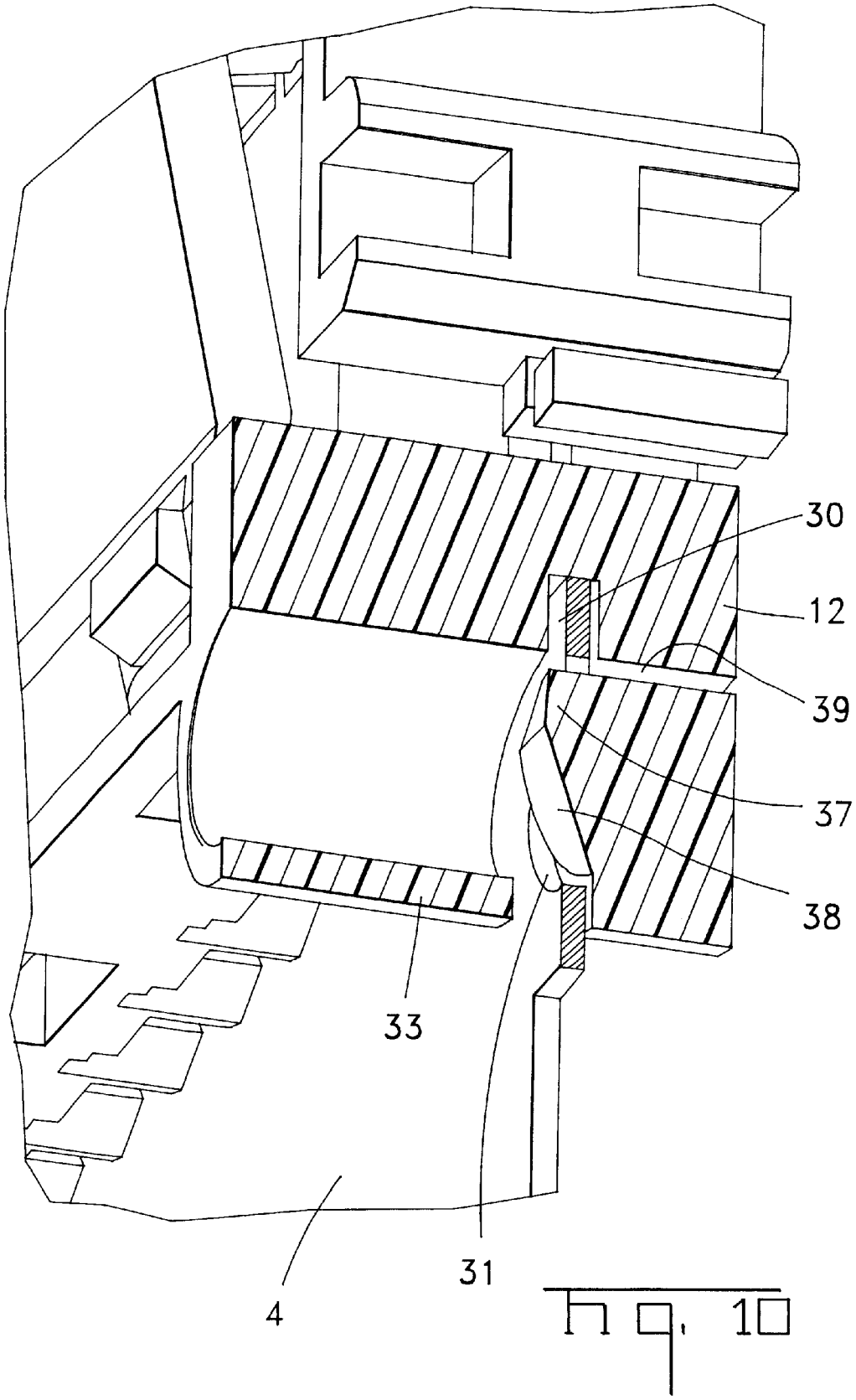
FIG. 10 is a perspective view with a partial cross-section through a strain relief arrangement with an opening and opposing elevation.
Figure 11:
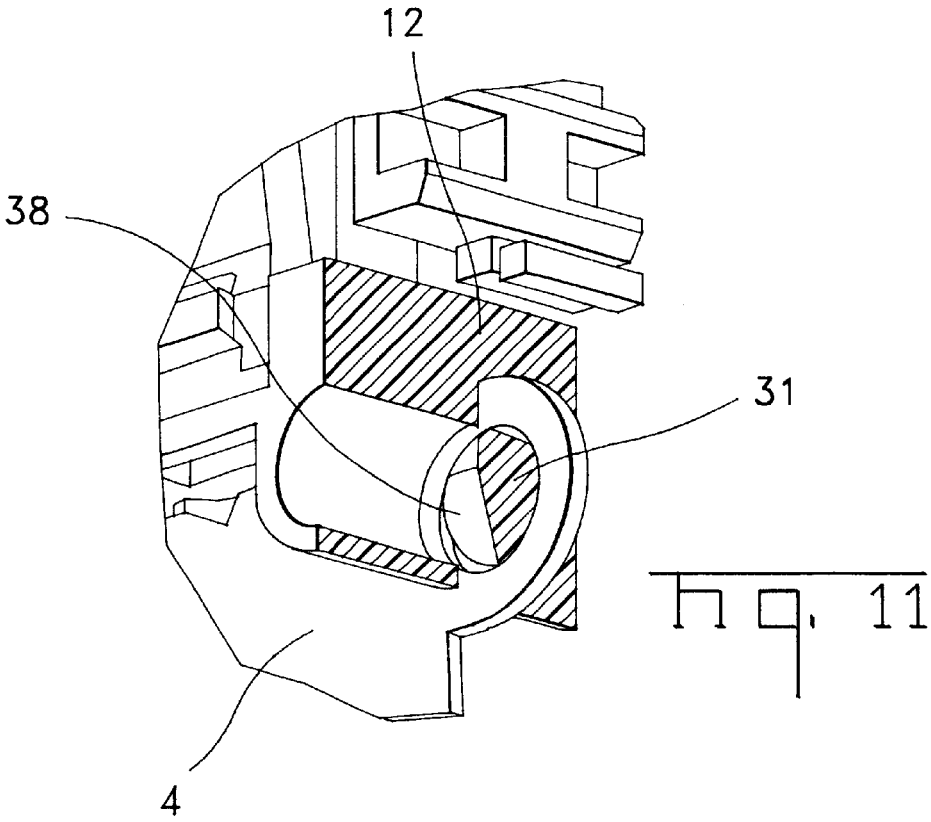
FIG. 11 shows a detail in perspective with a corresponding part section.
Figure 12:
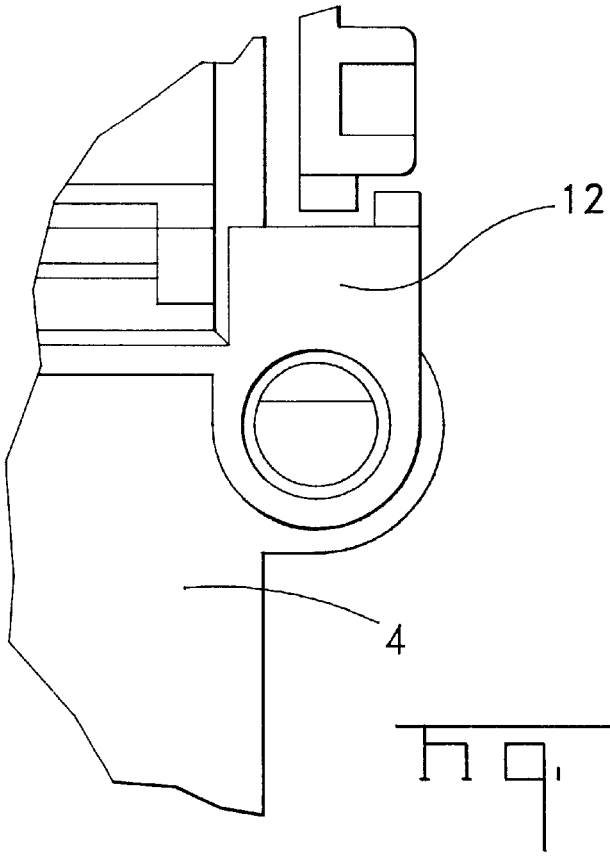
FIG. 12 is a plan view of the corresponding arrangement.

A second embodiment of the strain relief 12 will be described with reference to FIGS. 10 to 12. The strain relief 12 also includes a slot 31 and the foil 4 is also provided with an opening 31. There is also a hollow cylinder or relief 33 on one side of the slot 31. On the other side of the slot 31, however, there is a post 37 which has a bevel 38 toward the opening side of the slot 31. The diameter of the post 37 is somewhat smaller than the internal width of the hollow cylinder 33. The post 37 is also connected to the housing 2 on one side only and has a slot 39 on the other side so that the post 37 is slightly resilient. Owing to this arrangement, it is possible to introduce the foil 4 with opening 31 through the slot 31 and over the post 37 so that the foil 4 is secured against extracting forces.

We claim:

1. An electrical connector comprising a housing with a plurality of contact chambers arranged in at least one row for receiving contacts therein and a hinged flap having projections that extend into the contact chambers ion a locking position of the flap to secure the contacts therein, characterized in that a shaft of the flap is slidably introduced into a bearing track on the housing in a direction perpendicular to a mating direction of the connector and is rotatably mounted in the bearing track.

2. The electrical connector according to claim 1, characterised in that a locking nose is provided on at least one projection for locking the flap to the housing.

3. The electrical connector according to claim 1, characterised in that housing and flap are injection moulded as mutually independent parts and are assembled as the injection moulding tool is opened.

4. The electrical connector according to claim 1, characterised in that the flap can be introduced into the housing in a pre-locking position in which the flap is attached to the housing so the contacts could be introduced into the contact chambers and the flap is rotatable into the locking position.

5. The electrical connector according to claim 4, characterised in that a lug is provided on the side of the flap to secure the flap in the pre-locking position.

6. The electrical connector according to claim 1, characterised in that a strain relief is provided at the cable end of the connector for relieving the strain of the foil.

7. The electrical connector according to claim 6, characterised in that a strain relief arrangement is provided on each side of the row of contact chambers.

8. The electrical connector according to claim 6, characterised in that the strain relief includes a slot for receiving the foil.

9. The electrical connector according to claim 8, characterised in that a relief is provided on one side of the slot and post is provided on the opposite side of the slot so that the foil can be introduced over the post and be secured by the post.

10. The electrical connector according to claim 8, characterised in that the strain relief includes a coaxial hollow cylinder on each side of the slot and in that a pin is provided which can be introduced in an interlocking manner into one of the hollow cylinders to secure the foil.

11. The electrical connector according to claim 10, characterised in that the pin is connected to one of the hollow cylinders via a set breaking point.

12. An electrical connector for a flat foil conductor comprising a housing with a plurality of contact chambers arranged in at least one row for receiving contacts that form a connection to the flat foil conductor and for making contact with a mating contact, and a hinged flap characterized in that the flap includes projections that extend into the contact chambers in a locking position of the flap for securing the contacts therein and in that the flap include a shaft that can be slidably introduced in a bearing track on the housing in a direction perpendicular to a plug-in direction of the connector and is rotatably mounted in the bearing track.

13. An electrical connector for a foil comprising a housing with a plurality of contact chambers arranged in at least one row for receiving contacts that connect to flat foil conductors of the foil and for making contact with a mating contact and a hinged flap, characterized in that the flap includes projections that extend into the contact chambers when the flap is in an end locking position to secure the contacts therein and in that a strain relief is provided at a cable end of the contact for relieving strain induced upon the foil, wherein the strain relief includes a slot for receiving the foil, a coaxial hollow cylinder on each side of the slot and a pin which can be introduced in an interlocking manner in one of the hollow cylinders to secure the foil.

14. The electrical connector according to claim 13, characterised in that the strain relief is provided on each side of the row of contact chambers.

15. The electrical connector according to claim 13, characterised in that the pin is connected to one of the hollow cylinders via a set breaking point.

16. The electrical connector according to claim 13, characterised in that a relief is provided on one side of the slot and a post on the opposite side in such a way that the foil can be introduced over the post and be secured by the post.

* * * * *